US008579840B1

(12) United States Patent
Auletta

(10) Patent No.: US 8,579,840 B1
(45) Date of Patent: Nov. 12, 2013

(54) SPRING FINGERS MASSAGER

(76) Inventor: Lynda Auletta, Fort Lauderdale, FL (US)

( * ) Notice: Subject to any disclaimer, the term of this patent is extended or adjusted under 35 U.S.C. 154(b) by 1148 days.

(21) Appl. No.: 12/459,597

(22) Filed: Jul. 6, 2009

(51) Int. Cl.
*A61H 7/00* (2006.01)
*A61H 19/00* (2006.01)

(52) U.S. Cl.
USPC ..... 601/95; 601/84; 601/87; 601/89; 601/92; 601/93; 601/103

(58) Field of Classification Search
USPC ..... 601/84, 87, 89, 92–95, 103, 111, 117, 601/134, 136, 137; 119/174, 600–633; 132/119.1
See application file for complete search history.

(56) References Cited

U.S. PATENT DOCUMENTS 3,403,674 A * 10/1968 Alimanestiano ..... 601/134
5,016,617 A * 5/1991 Tarlow et al. ..... 601/117
5,063,911 A 11/1991 Teranishi
5,447,491 A * 9/1995 Bellandi ..... 601/112
6,039,703 A * 3/2000 Badilla ..... 601/61
6,213,963 B1 * 4/2001 Smith ..... 601/104
6,447,466 B1 * 9/2002 Smith ..... 601/104
6,679,858 B2 * 1/2004 Ray ..... 601/95
6,837,860 B1 1/2005 Auletta
7,087,029 B2 * 8/2006 Friedland ..... 601/72
8,088,086 B1 * 1/2012 Schmuck ..... 601/84
2005/0124921 A1 6/2005 Tseng
2006/0224092 A1 10/2006 Chou
2007/0167889 A1 7/2007 Kim

* cited by examiner

*Primary Examiner* — Patricia Bianco
*Assistant Examiner* — Brandon L Jackson
(74) *Attorney, Agent, or Firm* — Alvin S. Blum

(57) ABSTRACT

A massager has a base and a shaft mounted horizontally on the base. The shaft is rotated by a motor at a slow speed. The shaft has a plurality of spaced apart cams affixed to it. Elongate spring fingers are each affixed at one end to the base. Each finger has an intermediate portion that springably engages one of cams. A free end of the finger moves up and down as the cam rotates. The free end is provided with a projection that is suited to engage a body part. The projection is periodically pressed against the body as the cam rotates. The cams are mounted on the shaft so that they raise and lower the projections as different times. This action causes the projections to each press against the body at different times to emulate massaging fingers.

7 Claims, 3 Drawing Sheets

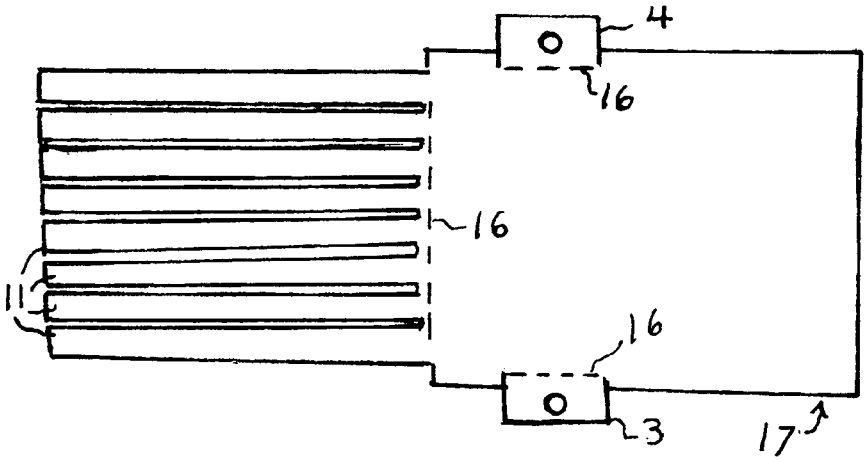
FIG. 4
FIG. 3
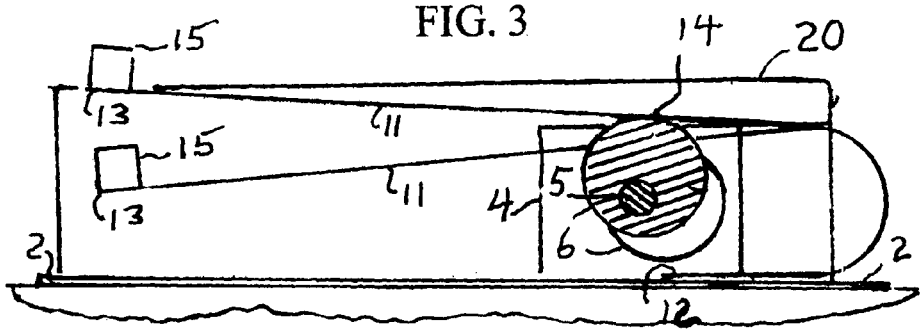

SPRING FINGERS MASSAGER

FIELD OF THE INVENTION

This invention relates generally to massagers, and more particularly to a massage unit that emulates a pair of hands with outstretched palms to receive the back of the head and fingers that periodically rise and fall to provide a hand-like massage.

BACKGROUND OF THE INVENTION

It is well known in the art to provide a mechanical massage unit operated by one or more motors. U.S. Pat. No. 6,837,860 issued Jan. 4, 2005 to applicant discloses a massage unit that has a plurality of fingers with individual motors that each drives a finger tip in a random elliptical manner. Each finger has three spaced-apart segments, springs and a motor for a complex structure with a finger motion that is not very close to the usual human operator massage. It would be more practical and commercially feasible to have a massager with few parts that would be inexpensive to produce and less prone to mechanical problems.

SUMMARY OF THE INVENTION

It is accordingly an object of the invention to provide an electrically driven massager that would emulate the fingers of both hands massaging a body portion such as the base of the head. It is another object that the massager be composed of few parts so that it would be economical to produce and trouble free.

The massager of the invention comprises a base and a shaft mounted horizontally on the base. The shaft is rotated by a motor at a slow speed. The shaft has a plurality of spaced apart cams affixed to it. Elongate spring fingers are each affixed at one end to the base. Each finger has an intermediate portion that engages one of cams. A free end of the finger moves up and down as the cam rotates. The free end may be provided with a projection that is suited to engage a body part. The projection is periodically pressed against the body as the cam rotates. The cams are mounted on the shaft so that they raise and lower the projections as different times. This action causes the projections to each press against the body at different times to emulate massaging fingers. It has been found that tension headaches can be relieved by massaging the base of the head. This apparatus makes it possible for a user to massage that part of the body without assistance by another person.

These and other objects, features, and advantages of the invention will become more apparent from the detailed description of an exemplary embodiment thereof as illustrated in the accompanying drawings, in which like elements are designated by like reference characters in the various drawing figures.

BRIEF DESCRIPTION OF THE DRAWINGS

FIG. 3 is a sectional view through line 3-3 of FIG. 5.

FIG. 4 is a top view of a sheet from which the base, supports, and fingers may be formed.

DETAILED DESCRIPTION OF PREFERRED EMBODIMENTS

Figure 1:
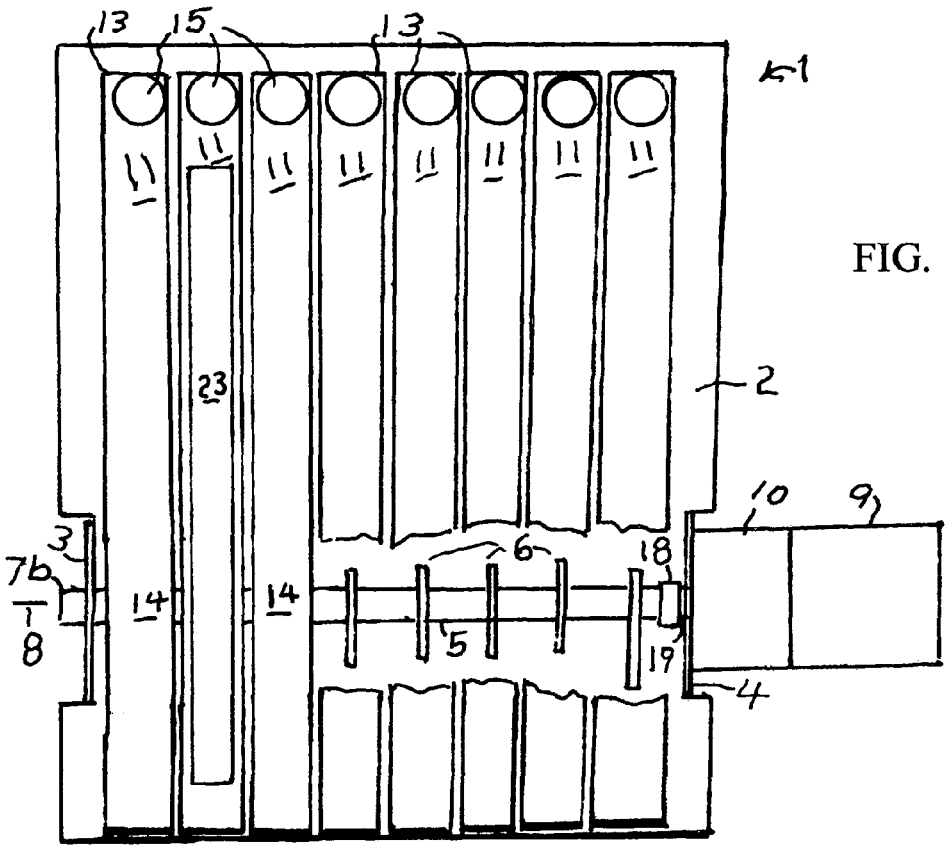
FIG. 1 is a top view of a massager of the invention, partially cut away.
Figure 2:
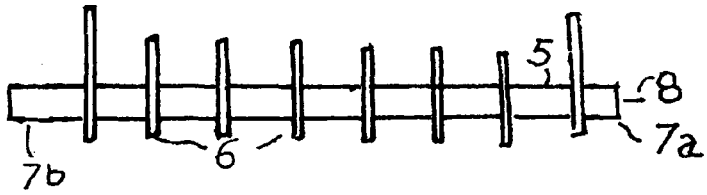
FIG. 2 is a top view of the shaft with cams.

Referring now first to the drawing Figures, the massager 1 of the invention includes a base member 2. Upstanding from the base member are a first support member 3 and a second support member 4. An elongate shaft 5 has a plurality of cams 6 affixed to it in spaced apart relation. The number of cams and their spacing may vary. In this case, there are eight cams spaced apart approximately as are the fingers on two hands of a person massaging the base of the head of a person. The shaft terminates in rotary elements 7*a* and 7*b* that are aligned along a common axis 8. An electric motor 9 drives a reduction gear assembly 10 whose output 19 is coupled by coupling 18 to rotary element 7*a* to thereby rotate the shaft 5.

A plurality, in this case eight, of elongate spring fingers 11 are each affixed at a first end 12 to the base, being distributed so that an intermediate portion 14 of each finger is engaging the exterior surface of a separate cam by spring bias. A free end 13 of each finger moves up and down as the cam rotates. A projection 15 on the free end of each finger is adapted to comfortably engage a body part as it moves up and down by the cam action as the distance of the contact of the cam with the finger from the common axis 8 changes with shaft rotation. The cams are disposed on the shaft such that the fingers move up and down at different times during the shaft rotation to thereby emulate a useful massaging action. A stiffening element 23 may be embossed or adhered to a portion of spring finger 11 to make that portion less flexible, if desired.

Figure 5:
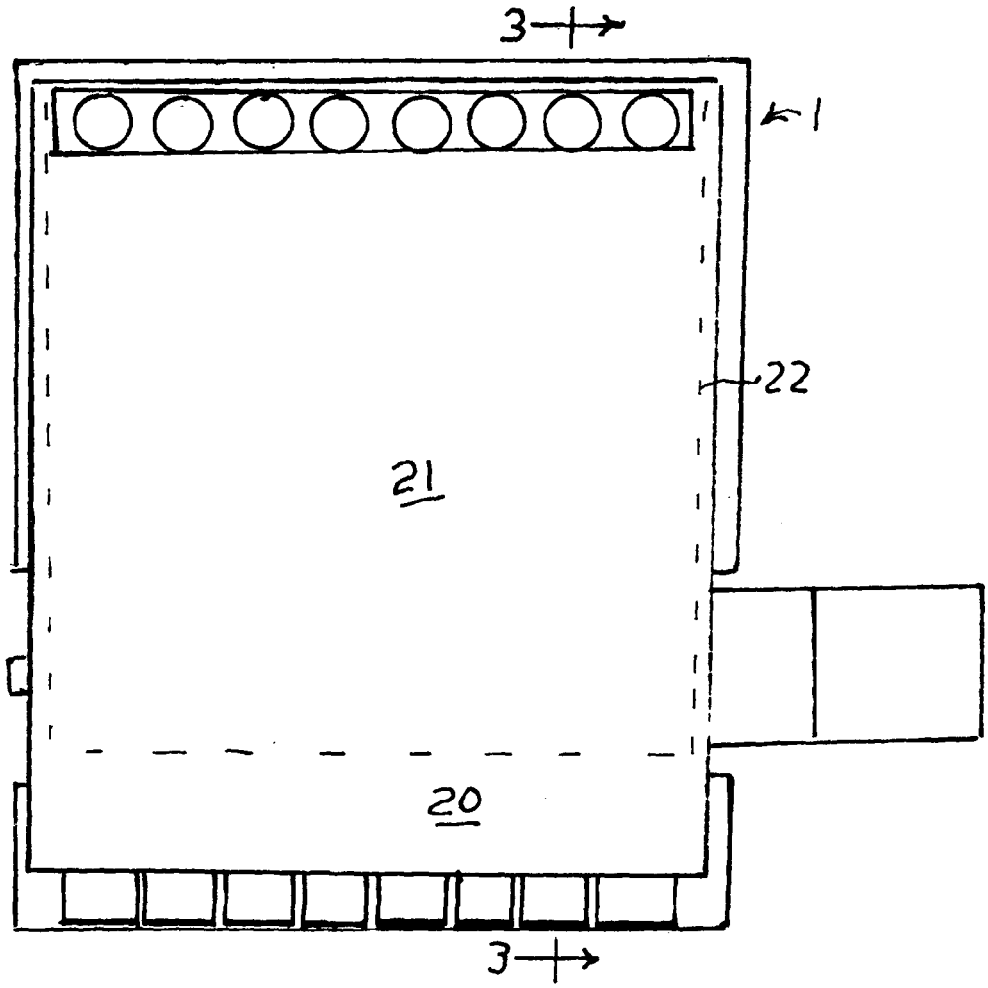
FIG. 5 is a top view of the invention with a head support in place.

A head support 20 may optionally be provided to hold the head in position, while the projections 15 extend beyond the head support 20 and massage the base of the head or the neck. A removable, resilient sheet 21 that attaches to the head support by hook and loop fasteners 22 may be provided to be cleaned and/or replaced between users. The fingers, support members and base may be formed from a single sheet 17 of material by folding along lines 16, as shown in FIG. 5, if desired.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Apparatus for massaging a body part of a user, the apparatus comprising:

a horizontal base member;

a pair of upright support members extending upwardly from the base member;

an elongate shaft having a plurality of spaced-apart cams affixed along a central portion and terminating at both ends in rotary elements aligned along a common axis, the rotary elements rotatably supported by the upright support members;

an electric motor coupled to a reduction gear assembly;

an output of the reduction gear assembly coupled to one of the rotary elements of the shaft;

a plurality of elongate spring fingers, each finger having a first end directly fixed to the base, an intermediate portion springably engaging an exterior surface of one of the cams, and a free second end provided with a projection adapted to comfortably press against a body part;

the cams and fingers cooperating so that rotation of the cam forces the free second end of the finger to move away from the base as the distance from the cam surface in contact with the finger to the common axis increases, while spring bias moves the free second end closer to the base as that distance decreases; and the cams being disposed on the shaft such that the free second ends of the lingers move away from the base at different times during rotation of the shaft.

2. The apparatus according to claim 1 in which the base and the spring lingers are comprised of a single sheet of material.

3. The apparatus according to claim 1 further comprising a resilient sheet covering the lingers.

4. The apparatus according to claim 1 further comprising a head support covering a portion of the spring fingers.

5. The apparatus according to claim 1 further comprising a head support covering a portion of the spring fingers and a resilient sheet covering the fingers.

6. Apparatus for massaging a body part, the apparatus comprising:

a horizontal base member;

a pair of upright support members extending upwardly from the base member;

an elongate shaft having a plurality of spaced-apart cams affixed along a central portion and terminating at both ends in rotary elements aligned along a common axis, the rotary elements rotatably supported by the upright support members;

an electric motor coupled to a reduction gear assembly;

an output of the reduction gear assembly coupled to one of the rotary elements of the shaft;

a plurality of elongate spring fingers, each finger having a first end directly fixed to the base, an intermediate portion springably engaging an exterior surface of one of the cams, and a free second end provided with a projection adapted to comfortably press against a body part;

the cams and fingers cooperating so that rotation of the cam forces the free second end of the finger to move away from the base as the distance from the cam surface in contact with the finger to the common axis increases, while spring bias moves the free second end of the finger closer to the base as that distance decreases;

the cams being disposed on the shaft such that the free second ends of the fingers move away from the base at different times during rotation of the shaft; and a body support disposed over the fingers to prevent the fingers from engaging the body, while enabling the projections to pass the body support and periodically engage the body part.

7. The apparatus according to claim 6 further comprising a removable resilient sheet covering the body support and the projections.

* * * * *